US005373273A

United States Patent [19]

Guery et al.

[11] Patent Number: 5,373,273

[45] Date of Patent: Dec. 13, 1994

[54] ELECTRIC CIRCUIT-BREAKER OF THE MAGNETIC ARC EXTINCTION TYPE

[75] Inventors: Jean-Pierre Guery, Bezons; Jean-Luc Mertz, Grenoble; Jacques Olifant, Nanterre, all of France

[73] Assignee: Telemecanique, Rueil Malmaison, France

[21] Appl. No.: 121,879

[22] Filed: Sep. 17, 1993

[30] Foreign Application Priority Data

Sep. 25, 1992 [FR] France ..... 92 11569

[51] Int. Cl.[5] ..... H01H 75/00

[52] U.S. Cl. ..... 335/201; 200/144 R; 200/147 R; 335/132; 335/16

[58] Field of Search ..... 335/201, 132, 133, 202; 200/144 R, 147 R

[56] References Cited

U.S. PATENT DOCUMENTS 4,086,460 4/1978 Gillette ..... 200/147 R
4,618,748 10/1986 Mueller ..... 200/147 R
4,654,491 3/1987 Maier et al. ..... 200/147 R
4,973,805 11/1990 Paton et al. ..... 200/147 R
5,142,111 8/1992 Blanchard et al. ..... 200/147 A

FOREIGN PATENT DOCUMENTS 0104981 4/1984 European Pat. Off. .
2378344 8/1978 France .
2604026 3/1988 France .
3302884 8/1983 Germany .

*Primary Examiner*—Lincoln Donovan
*Attorney, Agent, or Firm*—Oblon, Spivak, McClelland, Maier & Neustadt

[57] ABSTRACT

An electric circuit-breaker of the magnetic arc extinction type includes a fixed contact member comprising two electrically insulative parts. An auxiliary part of the fixed contact member is connected to an auxiliary terminal and includes an arc deflector branch so disposed that when the contacts open the current flows in opposite directions in this branch and in the mobile contact member.

8 Claims, 4 Drawing Sheets

ELECTRIC CIRCUIT-BREAKER OF THE MAGNETIC ARC EXTINCTION TYPE

BACKGROUND OF THE INVENTION

1. Field of the Invention

The present concerns an electric circuit-breaker of the magnetic arc extinction type comprising separable contacts respectively disposed on a fixed contact member and on a mobile contact member coupled to an actuator mechanism which can be tripped in response to an excess current.

2. Description of the Prior Art

The patent EP-104 981 describes a circuit-breaker/-contactor device whose circuit-breaker part comprises separable mechanical contacts in series with a solid-state switch constituting the contactor pare of the device. An arc electrode associated with the contacts is connected to a circuit shunting the solid-state switch. The shunt circuit is adapted to capture the arc immediately the contacts open in order to protect the solid-state switch. In this device the quality of magnetic arc extinction is worth enhancing in some cases to improve the quality of current interruption.

SUMMARY OF THE INVENTION

An object of the invention is to achieve excellent quality of current interruption in an electromagnetic circuit-breaker in a simple way.

Another object of the invention is to confer the benefits of improved current interruption on a device in series with the separable contacts and readily connectable to the circuit-breaker.

The present invention comprises a circuit-breaker of the magnetic arc extinction type comprising at least one fixed contact and one mobile contact that are separable and are respectively disposed on a fixed contact member and a mobile contact member in which circuit-breaker said mobile contact member is coupled to an actuator mechanism adapted to be tripped in response to an excess current and said fixed contact member is connected to an electrical device to be protected and having a first conductive part which comprises in the vicinity of said mobile contact member a branch disposed so that when said contacts are closed the current flows in the opposite direction in said branch and in said mobile contact member and a second conductive part near said first part but electrically insulated therefrom by an insulative gap which the arc is able to jump and which comprises an arc deflector branch so disposed that when said contacts open the current flows in the opposite direction in said branch and in said mobile contact member.

By the disclosed arrangement of the deflector branch, which is selectively aligned with the branch carrying the fixed contact, satisfactory magnetic arc extinction is achieved even if the arc has bridged the insulating gap between the two parts of the fixed contract member.

The deflector branch of the fixed contact member may advantageously be connected to an auxiliary terminal of the circuit-breaker which is preferably accessible from the front.

BRIEF DESCRIPTION OF THE DRAWINGS

Other advantages and features of the invention will emerge from the following description of one embodiment of the invention given by way of example with reference to the appended drawings.

DETAILED DESCRIPTION OF THE INVENTION

Figure 1:
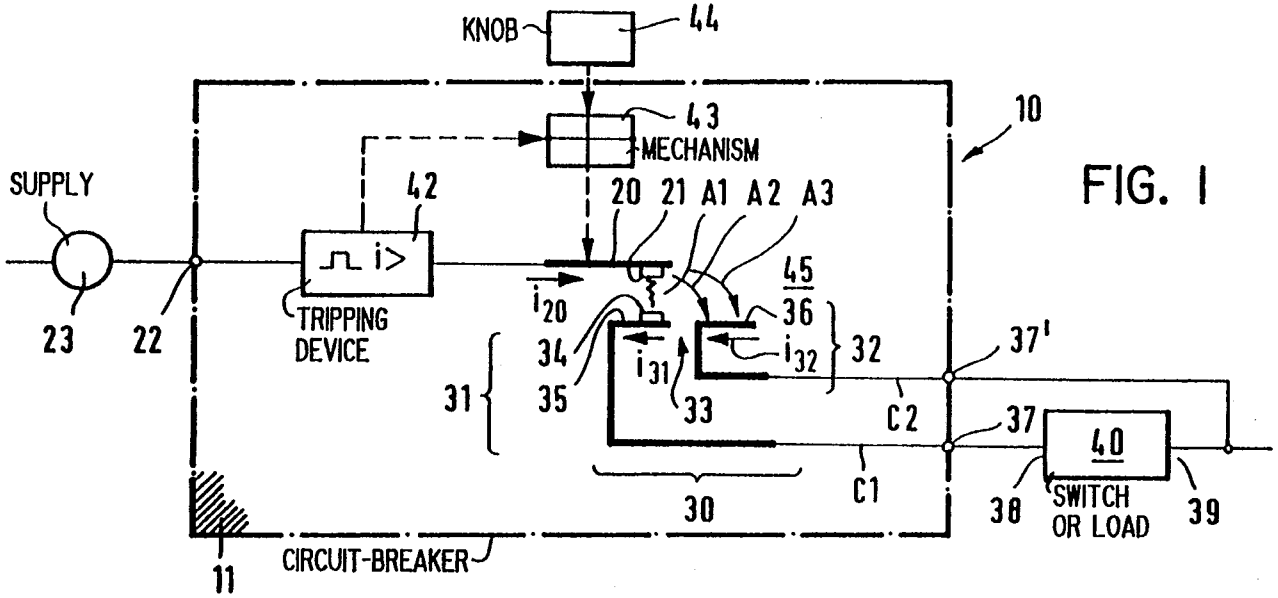
FIG. 1 is a circuit schematic of a circuit-breaker implementing the invention.

FIG. 1 shows an electric circuit-breaker 10 comprising in a casing 11 an electromechanical interrupter unit having a mobile contact member 20 and a fixed contact member 30.

The mobile contact member 20 carries the mobile contact 21 and is connected by appropriate conductors to an input terminal 22 of the circuit-breaker and thence by external wiring to a low-voltage electrical power supply 23. As used in the present context the expression "circuit-breaker" means any device of the circuit-breaker type, particular circuit-breaker/contactor combinations and other combinations of a circuit-breaker with another electric device.

The fixed contact member 30 has two parts 31 and 32 which are electrically insulated from each other by an insulating gap 33. The main part 31 of the member 30 carries the fixed contact 34 and is part of a normal current path C1; the auxiliary part 32 of the member 30 is part of an auxiliary current path C2; the current flows along the paths C1 and then C2 when the contacts 21, 34 are closed and then during the transient contact opening phase; during this phase the arc struck between the contacts jumps from the part 31 to the part 32 across the insulating gap 33; the successive phases of the arcing phenomenon are denoted A1, A2, A3.

Note that the respective parts 31, 32 of the fixed contact member 30 are both approximately J-shaped and that each therefore comprises a branch 35, 36 near the mobile contact and substantially parallel to the member 20, with a view to displacing the arc towards the interrupter chamber 45. Respective currents $i_{31}$, $i_{32}$ flow in the branches 35, 36 in the opposite direction to the current $i_{20}$ in the adjacent mobile contact member 20 —arm or bridge—respectively when the device is closed and during the transient contact opening phase.

The normal current path C1 connects the main part 31 of the fixed contact member 30 to a first output terminal 37 of the circuit-breaker and thence by external wiring to an input terminal 38 of a unit 40 to be protected such as a solid-state switch, a contactor or some other load. The auxiliary current path C2 connects the auxiliary part 32 of the member 30 to a second output terminal or auxiliary terminal 37' of the circuit-breaker; the terminal 37' is connected by external wiring to an output terminal 39 of the unit 40. The mobile contact member 20 is connected to the input terminal 22 of the circuit-breaker via a magnetic or magnetothermal tripping device 42 which through the intermediary of a mechanism 43 causes the contacts to be opened as soon as it senses an excess current. The contacts can also be opened and closed by means of a knob 44.

Figure 2:
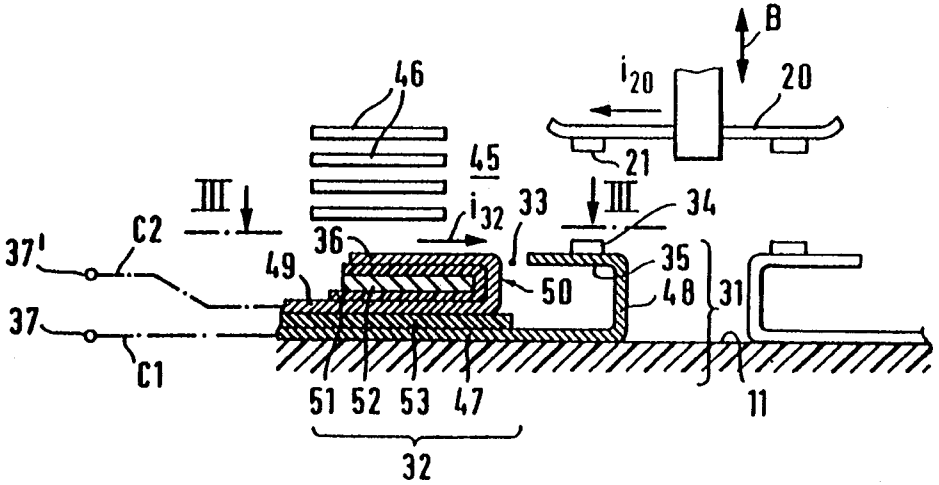
FIG. 2 shows one embodiment of the invention.
Figure 3:
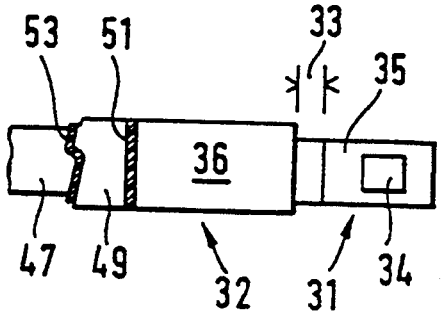
FIG. 3 shows part of FIG. 2 in cross-section on the line III—III.

In the FIG. 2 embodiment the circuit-breaker has a mobile contact member 20 in the form of a twin-contact bridge moveable in translation in the direction of the arrow B. The deflector branch 36 of the part 32 is contiguous with an interrupter chamber 45 containing plates 46 which subdivide the arc. The part 31 has a branch 47 connected to the terminal 37 parallel to the branch 35 which carries the fixed contact and connected to this branch by a perpendicular branch 48. The part 32 has a branch 49 connected to the other component parts of the shunt path C2. The branch 49 is parallel to the deflector branch 36 and is connected to it by a bent perpendicular branch 50. An air gap is provided or a thin layer of insulation 51 may be inserted between the branches 36, 49 together with a ferromagnetic member 52 to enhance the magnetic field induced by the current the branch 36. There is an air gap or a dielectric 53 between the branches 47, 49.

Figure 4:
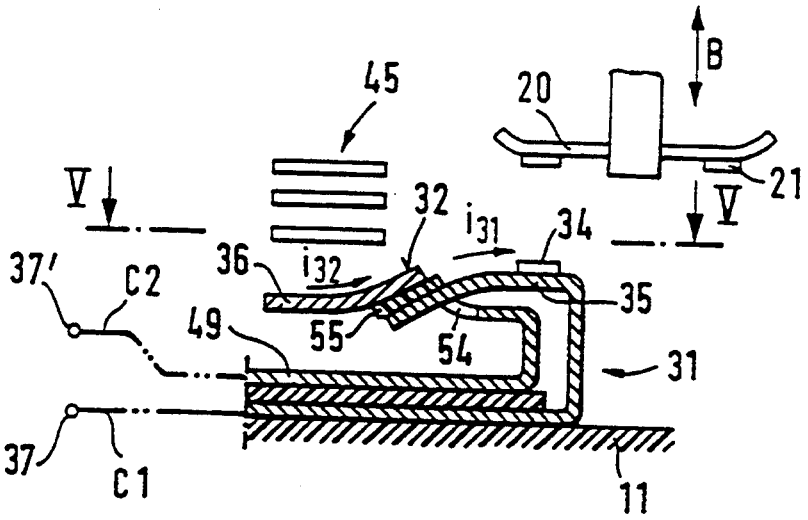
FIG. 4 shows an alternative embodiment.
Figure 5:
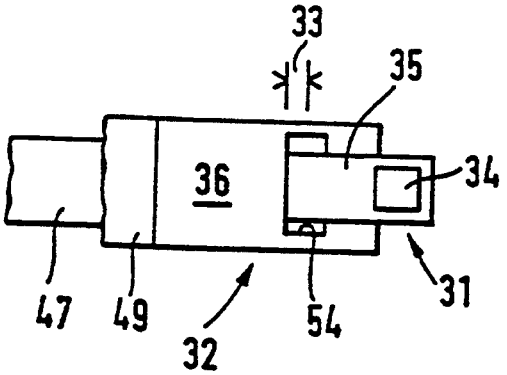
FIG. 5 shows part of FIG. 4 in cross-section on the line V—V.

In the FIG. 4 embodiment the branch 35 of the part 31 which carries the fixed contact enters an opening 54 in the deflector branch 36 of the part 32. Insulation 55 is disposed between the branches 35, 36 near the edge of the opening.

The circuit-breaker shown operates as follows. It is assumed that initially the contacts are closed and the current flows along the path C1. If the magnetothermal device 42 senses an excess current it causes the mechanism 43 to open the contacts. The arc which is struck between the contacts 21, 34 (state A1) moves towards the right (FIG. 1) and jumps the insulative gap 33 (state A2). The current then flows along the shunt path C2; as it flows in the deflector branch 36 in the opposite direction to that in which it flows in the mobile contact member 20 (state A3), the resulting magnetic field continues to drive the arc towards the right (FIG. 1) and therefore towards the plates which divide it.

Figure 6:
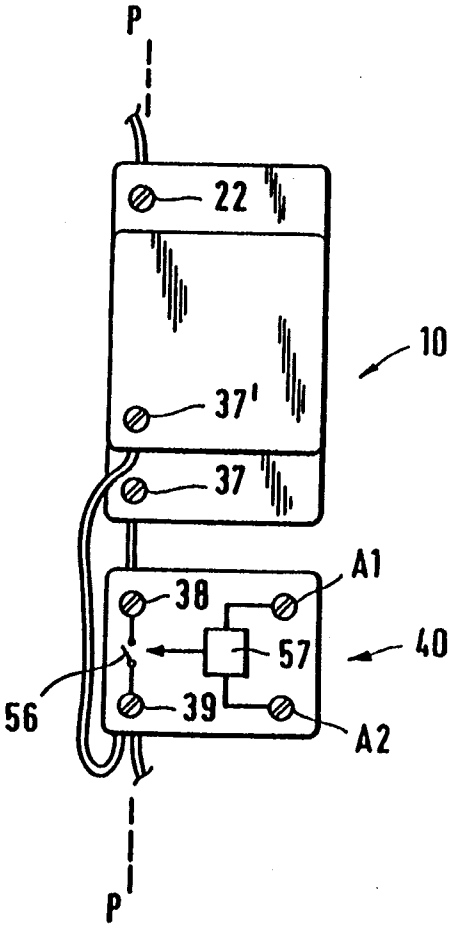
FIG. 6 shows the combination of a circuit-breaker and a contactor as seen from the front.

FIG. 6 shows one example of a combination of a circuit-breaker with a contactor 40 which comprises a separable contact or solid-state type switch 56 controlled by an electromagnetic or electronic unit 57, respectively. The control unit 57 is connected control terminals A1, A2. The output terminals 37 and 37' of the circuit-breaker are respectively connected to the input terminal 38 and to the output terminal 39 of the contactor. The terminals 22, 37, 37', 38, 39 of the same pole are accessible from the front and are advantageously in a plane P perpendicular to the front surfaces of the circuit-breaker and the contactor so that the good current interrupting properties of the circuit-breaker can be obtained with a contactor of variable rating easily connected to the circuit-breaker.

Figure 7:
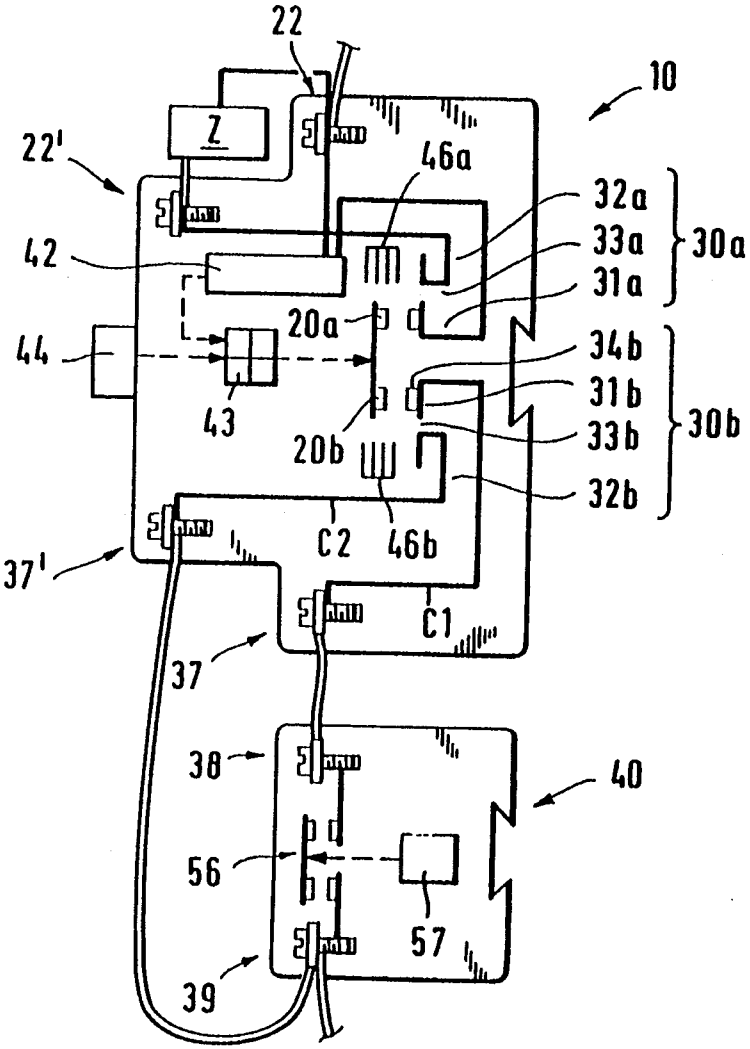
FIG. 7 shows the combination of an alternative embodiment of the circuit-breaker and a contactor as seen from the side.

In the FIG. 7 embodiment the circuit-breaker is associated with a contactor 40. The circuit-breaker includes a mobile contact bridge 20 which carries two contacts **20*a*, 20*b* which cooperate with respective fixed contacts 34*a*, 34*b* carried by fixed contact members 30*a*, 30*b***.

Each of the latter has two contiguous J-shaped parts **31*a*, 31*b* and 32*a*, 32*b* insulated from each other by an insulative gap 33*a*, 33*b* in the vicinity of plates 46*b* which cool and divide the arc. The main output terminal 37 and the auxiliary output terminal 37' are respectively joined to the parts 31*b*, 32*b* of the fixed member 30*b* and are connected as previously described to the terminals 38, 39** of the contactor.

The parts **31*a*, 32*a* of the fixed member 30*a* are respectively connected to the main input terminal 22 and to an auxiliary input terminal 22'. A current limiting impedance Z is connected between the input terminals 22, 22'. Opening of the contacts in response to a short-circuit therefore connects the following circuit temporarily, meaning during the arcing phenomenon: terminal 22-impedance Z-terminal 22'**, so that the arc current is limited accordingly.

Figure 8:
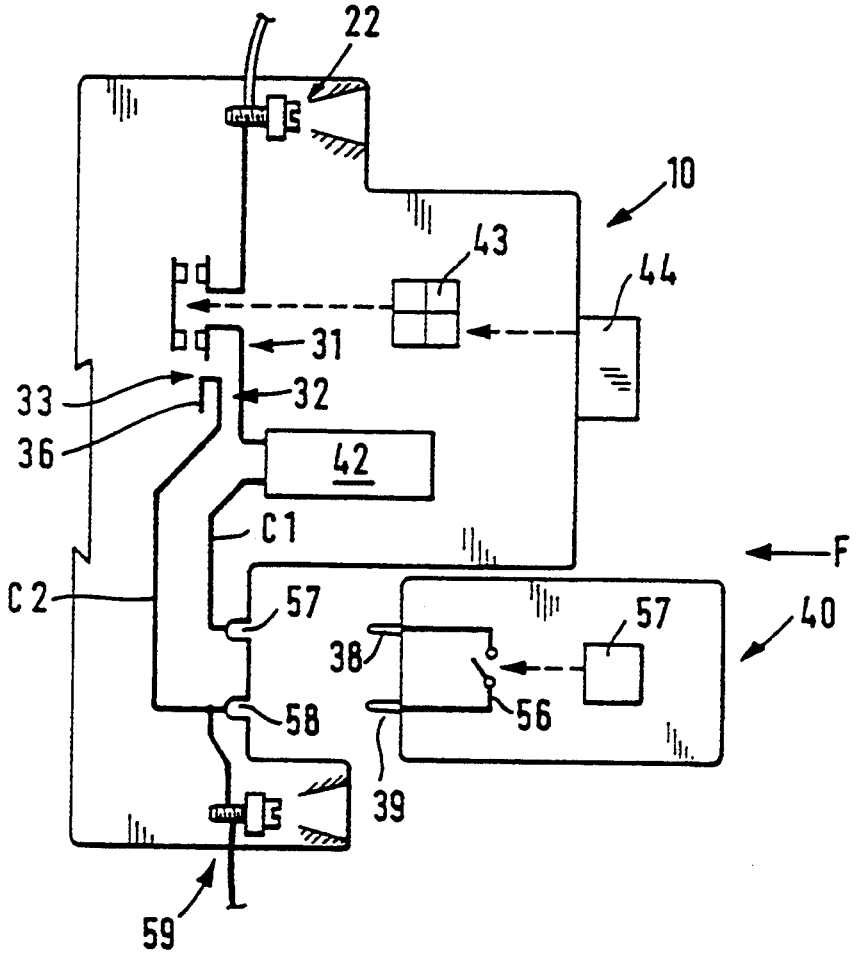
FIG. 8 shows an alternative embodiment of the circuit-breaker as seen from the side.

Instead of comprising the electrical interconnection of two mechanically independent devices 10, 40, the device may comprise a circuit-breaker 10 into which the contactor 40 plugs in the direction of the arrow F (FIG. 8). In this case the contactor 40 has an input pin 38 and an output pin 39 which connect to respective output terminals 57, 58. The terminal 58 is connected to a terminal 50 connected to the load circuit and to the part 32 of the fixed contact member 30 via the path C2. The terminal 57 is connected to the part 31 via the auxiliary path C1.

The invention can be applied to single-contact and twin-contact circuit-breakers adapted to be associated with electromechanical or solid-state contactors.

There is claimed:

1. A circuit breaker comprising:

at least one fixed member including a fixed contact;

at least one mobile member including a mobile contact;

an actuator for actuating the mobile contact to be in contact with and open from the fixed contact, the actuator being tripped in response to an excess current;

an electrical device to be protected from the excess current and connected to the fixed contact;

wherein said at least one fixed member comprises a first branch on which the fixed contact is formed and a second branch electrically insulated by a first insulative gap from the first branch, and wherein when the mobile contact is in contact with the fixed contact, current flows from the mobile contact through the first branch in a direction opposite to a current flow through the mobile member, and wherein when the mobile contact is open from the fixed contact, current flows from the mobile contact through the second branch in a direction opposite to the current flow through the mobile member.

2. The circuit-breaker according to claim 1, wherein said first branch of said at least one fixed contact member comprises a bent portion disposed in a vicinity of said insulative gap and a connecting portion connected to said electrical device to be protected.

3. The circuit-breaker according to claim 2, wherein an insulator is disposed between said bent portion and said connecting portion.

4. The circuit-breaker according to claim 2, wherein a ferromagnetic member is disposed between said bent portion and said connecting portion.

5. The circuit-breaker according to claim 1, wherein said first branch of said at least one fixed member is inserted in an opening in the second branch of said at least one fixed member with an electrical insulator disposed between said first branch and said second branch near an edge of said opening.

6. The circuit-breaker according to claim 1, wherein said second branch of said at least one fixed member is a J-shaped member connected directly to an auxiliary terminal of the circuit-breaker.

7. The circuit-breaker according to claim 1, wherein said fixed contact and mobile contact are both twin contacts.

8. The circuit-breaker according to claim 7, wherein the at least one fixed member has two conductive parts separated by a second insulative gap and which are selectively interconnected via an arc current limiter impedance.

* * * * *